US011591816B1

(12) United States Patent
Allen

(10) Patent No.: US 11,591,816 B1
(45) Date of Patent: Feb. 28, 2023

(54) TRANSVERSE ELEVATOR SYSTEM

(71) Applicant: Dillis Victor Allen, Schaumburg, IL (US)

(72) Inventor: Dillis Victor Allen, Schaumburg, IL (US)

(73) Assignee: Vardon, Inc., Schaumburg, IL (US)

( * ) Notice: Subject to any disclaimer, the term of this patent is extended or adjusted under 35 U.S.C. 154(b) by 0 days.

(21) Appl. No.: 16/299,373

(22) Filed: Mar. 12, 2019

(51) Int. Cl.

| | |
|---|---|
| ***E04H 6/28*** | (2006.01) |
| ***E04H 6/18*** | (2006.01) |
| ***E04H 6/42*** | (2006.01) |
| ***E04H 6/22*** | (2006.01) |

(52) U.S. Cl.
CPC ..... *E04H 6/28* (2013.01); *E04H 6/187* (2013.01); *E04H 6/42* (2013.01); *E04H 6/22* (2013.01)

(58) Field of Classification Search
CPC ..... E04H 6/28; E04H 6/22; E04H 6/42
See application file for complete search history.

(56) References Cited

U.S. PATENT DOCUMENTS 1,741,203 A * 12/1929 Rowe ..... B61B 1/02 104/124
3,688,921 A * 9/1972 Zaha ..... E04H 6/14 414/233
3,743,116 A * 7/1973 Giessler ..... B65G 37/02 414/279
3,858,518 A * 1/1975 Nyman ..... E01D 11/02 104/124
3,896,736 A * 7/1975 Hamy ..... B66B 9/10 104/127
4,386,581 A * 6/1983 Rokhvarg ..... A01K 1/0041 119/14.03
4,394,837 A * 7/1983 Edwards ..... B61B 3/02 104/119
5,172,640 A * 12/1992 Cathiard ..... B61B 7/04 104/173.2
6,240,851 B1 * 6/2001 Oudakker ..... B61B 15/00 104/127
7,832,339 B2 * 11/2010 Richard ..... B61B 12/022 104/173.1
9,010,251 B2 * 4/2015 Creissels ..... B61B 1/02 104/30
10,202,259 B2 * 2/2019 Scomparin ..... B61B 5/02
10,472,842 B2 * 11/2019 Lee ..... E04H 6/285
10,794,077 B1 * 10/2020 Chang ..... E04H 6/22
2010/0319565 A1 * 12/2010 Mobasher ..... H02S 20/21 104/89

(Continued)

*Primary Examiner* — Kaitlin S Joerger

(57) ABSTRACT

A transverse elevator system having generally horizontal and generally vertical components in a building with horizontal pathways guiding first passenger vehicles on each floor that connect to a plurality of vertical pathways guiding second passenger vehicles intersecting the horizontal pathways at stops at the points of intersection, wherein passenger transfer from horizontal to vertical movement is achieved by locking the first vehicles to the second vehicles with passenger chutes defining panels that extend from the vertical pathways and lock the first vehicles to the vertical pathways. In a second embodiment, passengers are carried in a separate enclosed CAPULSEs that shift from the first vehicles to the second vehicles obviating the need for complex horizontal to vertical drive transfer mechanisms.

21 Claims, 10 Drawing Sheets

(56) References Cited

U.S. PATENT DOCUMENTS

| | | | | |
|---|---|---|---|---|
| 2013/0180425 | A1* | 7/2013 | Creissels | E01F 1/005<br>104/28 |
| 2018/0319630 | A1* | 11/2018 | Dayrell | B66B 9/022 |
| 2020/0377332 | A1* | 12/2020 | Thum | B66B 9/003 |

* cited by examiner

TRANSVERSE ELEVATOR SYSTEM

BACKGROUND OF THE INVENTION

Those rare individuals and silicon valley dreamers that have long been second guessing the future of transportation systems, many ideas percolates unsteady futures of our present day automobile and transport systems replaced with autonomous vehicles replacing present day sleek luxurious and self gloating expensive driver only cars, such as the Bentley Continental GT, the Mercedes S550 sedan, the Lexus LC500, and Ferrari and Lomborgini sports cars many in the ½ million US dollar range. Yet the dichotomy of this in part that is the manufacturers of these expensive ones are the very same perpetrators of the advancement of autonomous vehicles-a strategy that will no doubt spell the death of those car and transport companies in the 2025 to 2040 time frame as these autonomous vehicles vastly reduce the need for 2 or 3 fancy cars in each family replaced by ride sharing in these self driving vehicles. As electric cars are already replacing internal combustion cars and trucks, the innovators of the autonomous technology have prompted their egos to move to other fields such as orbital passenger flights, electric airplanes with VTOL, and city to city vacuum tunnels dug by small diameter earth diggers—the later with difficult success in the Los Angeles to San Francisco route, or the Downtown Chicago to Ohare path although the Las Vegas convention center one-way circle has some support now. Unfortunately, these forward thinkers have not completely solved problems of the future much better than many visionist of the past such as Michelangelo, Leonardo de Vinci(Leonardo) and to some extent Edison and Franklin and Tesla, although study hints at cross currents in many of their guesses at the future, such as the light bulb and the bulk direct current transmission by Edison. We have seen similar technical or human deficiencies in the development of elevator technology over the last decade. This may be due in part by to a lack of technical expertise, but more likely by the reticence of building developers and government agencies to promote with sufficient funds those necessary to spur elevator technology ahead of what we know now in early 2019.

Because elevator systems require heavy and complex structures they define the basic structure of entire buildings, which are more likely dictated in shape by the cost of the underlying land resulting in very high structures with small footprints in for example, Manhattan N.Y., downtown Chicago, Dubai, Tokyo, and Hong Kong.

This resistance to new elevator technology is also dictated in part by the belief that the future requires both horizontal and vertical movement of passengers throughout the building structures. Now horizontal passenger systems including above and underground ones are almost always limited to horizontal only movement. And vertical elevator systems such as in the Willard tower in Chicago or the Empire State building in New York City are limited to vertical only movement. Some of the above forward thinkers have suggested systems with elevator cars shifting directions 90 degrees, but they offer no solution to the specific mechanisms the can efficiently make this direction change.

One of the reasons for the inhibition of efficient new designs of combined horizontal and vertical systems is the complexity of even modern day vertical only systems. Elevators for safety reasons and speed efficiency require, a plurality of heavy cables, 5 ton motors and heavy counterbalance mechanisms. Even low rise elevators use heavy hydraulic drives. If one were to design a right angle turn system using these drives, it would require the disconnection from these cables or hydraulics from the vertical shaftway and the reconnection to the horizontal pathway mechanisms. To automate such a system would require 90 degree transition times of at least 20 minutes, making even short passenger trips of one turn over ½ hour, such that passengers would prefer a slow walk to be the preferred option.

If one reviews the literature, one leader of elevator design and manufacturing, Otis Elevator Company of Farmington Conn. has not solved this problem even with highly skilled engineers Zbigniew Piech, Tadeusz Witczak and Jose Pasini and others. The Otis recent patents such as U.S. Pat. Nos. 10,017,354, 10,118,799 10,202,259 show these innovators have only ignored these problems. For example when describing its systems for changing elevator car directions they gloss over the problem by saying it can be done by a simple "carriage" without explaining how this simple device could actually accomplish this complex problem. For example in the U.S. Pat. No. 10,017,354 Ginsberg et al describe with reference to FIG. 3 in the patent that a transfer of vertical elevator car 14 can be accomplished from one vertical elevator shaft 17 to a parallel elevator shaft 15, and in column 2 lines 11 to 16 with the statement "The transfer supervisor 130 can enable or disable portions of the transfer station 32 to allow or prevent horizontal movement of the elevator car 14 in the transfer station 32. A carriage 33 may be employed to move the elevator car 14 in a horizontal direction bidirectionally between lanes 17 and 15" Not a word in this patent about how the car 14 is disconnected from path 14 or how car 14 is reconnected to path 17. In short, these Otis appear not to know how to accomplish those tasks-at least not efficiently. Why is it also, that Otis has no patents or publications attempting that task. But there are others who have tried.

A German company has designed and actually built a 90 degree turn system that it calls "the biggest development in the elevator industry since the invention of the safety elevator some 165 years ago". Nothing could be further from the truth. What the German company ThyssenKrupp has done is use the century old railroad turnabout to change directions of an elevator car. A video can be seen are www.wired.com/story/the-sideways-elevator-of-the-future-is-here/. The elevator car moves along rails and slows down and stops at a turret some 3 feet in diameter with tracks aligned with car rails. The turret rotates 90 degrees while the car remains stationary and after rotation the car attaches to the turret and follows the new rails.

While this system works. It takes over 22 seconds to complete a single turn, so if the horizontal loop of the system were ½ mile or 2,640 feet and there were only four stops, the delay of a single car in the loop would be over 100 seconds, bearing in mind that a car traveling at only ½ miles per hour would traverse such a loop without slowing in 14.6 seconds and the resulting 100 second additional delay would be unacceptable. While some developers may adopt the ThyssenKrupp system, there has to be a more efficient solution.

In Italy, in the Ascensore Castello d'Albertis-Montegalletto located in Genova(Genoa) just East of Arenzono, a railroad like horizontal trackway carries a removable car on a pallet to a vertical chute to which the car slowly and noisy, crudely attached after a long wait to cables in the chute. This system is too inefficient and slow to work in a modern building environment. See www.gizmodo.com/this-elevator-moves-both-horizontally-and-vertically-1776894453.

In short, elevator technology to date, is pale compared to other current technologies such as the Space-X first and unbelievable vertical undamaged landing of a main booster on the deck of a moving vessel in an open ocean. With that bright and recent event, there must be paths to more efficient, faster and lower cost elevator systems than the crude attempts thus far.

SUMMARY OF THE PRESENT TRANSVERSE ELEVATOR ASSEMBLY

In accordance with the present invention a transverse elevator assembly is provided having generally horizontal and generally vertical components in a building with horizontal pathways guiding first passenger vehicles on each floor that connect to a plurality of vertical pathways guiding second passenger vehicles intersection the horizontal pathways at stops at the points of intersection, wherein passenger transfer from horizontal to vertical movement is achieved by locking the first vehicles to the second vehicles with passenger chutes defining panels that extend from the vertical pathways and lock the first vehicles to the vertical pathways. In a second embodiment, passengers are carried in a separate enclosed capsules that shift from the first vehicles to the second vehicles obviating the need for complex horizontal to vertical drive transfer mechanisms.

The efficiency of a horizontal-vertical elevator system can be measured by the seconds or minutes required for each segment of its maximum journey in distance about the system. In a wide body building the shape, for example, of the Pentagon in Northern Virginia that has horizontal loops completely around the building, a horizontal path could be 2 miles in length, so one measure could by the time required for a transit vehicle including stops to complete one horizontal loop. Such a building could also accommodate a vertical elevator shaft one on each of the sides thus totaling 5 vertical shaft with 3 stops each, one on each floor.

According to the present invention, the horizontal pathways are traversed with self propelled cars with electric motors and newly improved GPS transponders accurate to 24 inches for feedback to the main control system. This control optimizes the speed of these cars and directs the path of these cars to each of vertical pathways that arte elevator shafts housing self propelled vertical passenger cars that could also be driven by present day cable systems, rather than being self propelled.

In this system the passenger can select, alternatively a shorter distance path or a shortest time path, each based on algorithms taught by experience in the actual system using artificial intelligence rather than hypothetical models.

Also, the controls fashion croups of passengers into each car so the actual path of the passengers is determined by compromises of the best path each passenger in the group. To further speed the passenger paths, the vertical shafts are bypassed by cars on a main horizontal track so they are not delayed waiting for a car ahead stopped at a vertical shaft for passengers transferring to a vertical car going up to a higher floor. This is effected by a switch controlled side track at each vertical elevator shaft. After dropping off a group or single passenger at a vertical stop, the side tracked car reenters the main pathway at an entry switch and the approaching cars on the main pathway are slowed if necessary to permit the safe reentry of the stopped car back onto the main horizontal pathway.

This innovation vastly improves average journey times in the entire system and is duplicated on each floor of the system, with similar horizontal pathways and vertical stops on each floor of the building.

This system can be used on tall buildings with small land footprints as well, but the horizontal paths on each floor would be correspondingly shorter.

An important aspect of this transverse elevator system is the mobility of passengers from the horizontal pathway cars to the vertical pathway cars. This provision shortens passenger transfer time and provides a rapid, safe, and comfortable movement of passengers throughout the system. This is achieved by passenger chutes comprised of partitions sliding from the vertical shaftways into engagement with a horizontal pathway car forming the enclosed chute, and locking to the car with rotary auger screws that are rubber dampened with a coating layer to reduce vibration and sound. Another feature of the present system are capsules that can be used with the above chutes that carry passengers throughout the system and eliminate the need in prior systems to disconnect and reconnect the cars as they shift from horizontal to vertical cars, or from the vertical cars back to a horizontal car. The chute technology however can be used without this chute system by other chute moving techniques such as drive wheels.

Other objects and advantages of the present system will be apparent from the following detailed description.

DETAILED DESCRIPTION OF THE PREFERRED EMBODIMENTS

Figure 1:
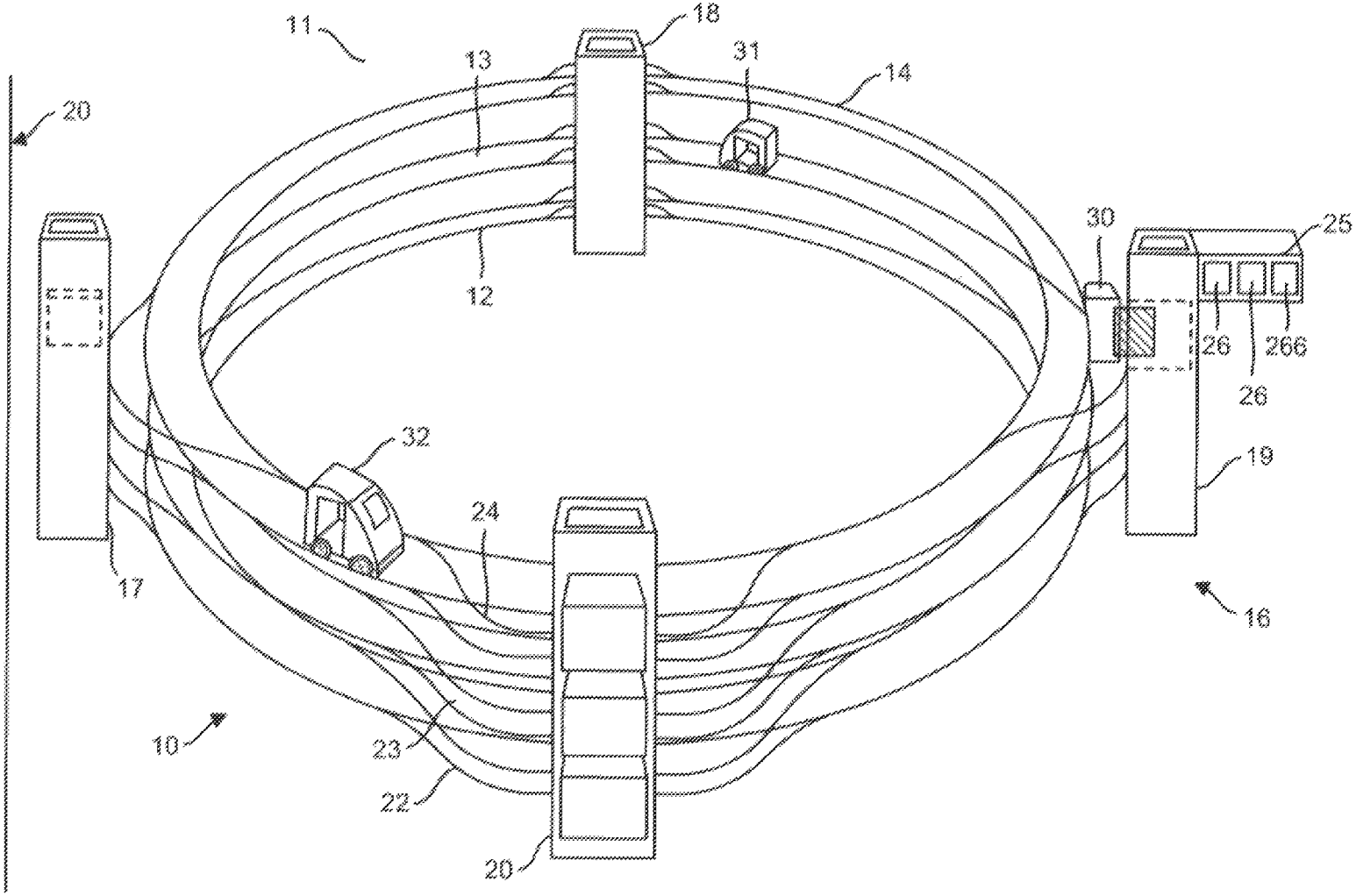
FIG. 1. Is a schematic view of a wide footprint building with the present transverse elevator system pathways show one horizontal pathway for each of its 3 floors and 4 vertical pathways connected to each of the horizontal pathways at 12 stops.
Figure 2:
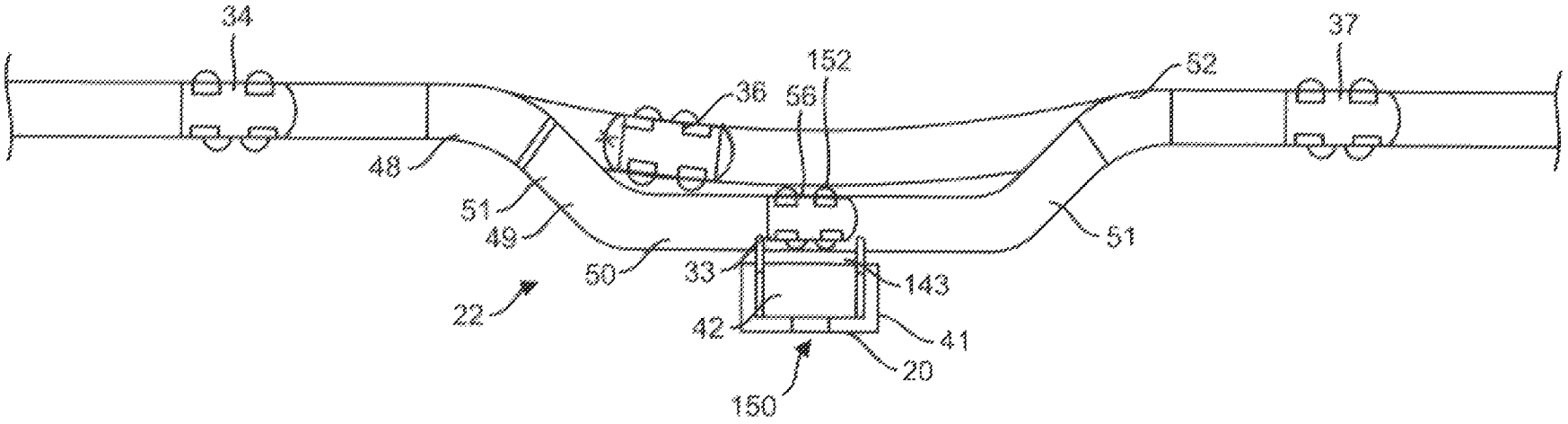
FIG. 2. Is a partial schematic of a single stop shown in FIG. 1, of the present present transverse elevator system, showing an exemplary side track at one of the stops shown also in FIG. 1.

Viewing the drawings and initially focusing on FIGS. 1 and 2, the present transverse elevator system 10 is shown incorporated into a large footprint low rise building 20 having less than 10 floors 20. While the system 10 is shown on a three floor building in the drawings, it could be used in a high rise building as well if that high rise could economically have transverse vehicular systems on some or all of its floors.

Such high rise buildings for example could have a wider footprint on its lower floors and narrower width at its higher floors so the present combined vertical and horizontal pathways system could be installed optionally only on those wider lower floors and vertical only elevators could be used on the upper floors.

Turning back to the drawings the present system to is seen to include a horizontal pathway system 11 including three floors of horizontal pathways 12, 13, and 14, and a vertical pathway system 16 consisting of four vertical pathways 17, 18, 19 and 20. With side track systems 22, 23 and 24 connecting each of the vertical pathways to the horizontal pathway system 11.

The horizontal pathway system 11 guides a plurality of self propelled cars 30, 31 and 32 shown in FIGS. 1 and 2. These cars 30, 31, and 32, as well as the other horizontal pathway cars shown throughout these drawings are electric motor driven controlled remotely by the controls shown in FIGS. 13 and 14, and have GPS output position feedback to the controls bearing in mind that GPS systems with higher accuracy have been commercially available for over one year. The vertical pathways also have remotely controlled cars mechanically driven by present day known cable systems but they could also have self propelled cars similar to the ones shown in the present horizontal pathways at 30, 31 and 32 with modified guiding trackways with more elaborate car floor stop mechanisms not shown in the present vertical shafting but being further developed by current technology.

Each of the vertical trackways and its associated sidetracks 22, 23, and 24 are the same and are illustrated in FIG. 2, with the understanding that each of the vertical pathways 17, 18 19 and 20 have three of the sidetrack systems illustrated in FIG. 2. one for each of the three floors of the building 20.

The purpose of the side tracks 22, 23 and 24 is decrease car route cycle time by permitting the cars to bypass the vertical pathways so cars stopping unloading or loading passengers at the stops do not delay cars n the horizontal pathways regardless of the length of time consumed by the stops.

Figure 4:
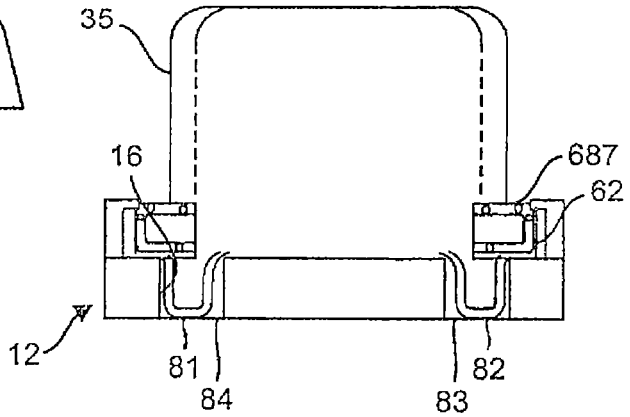
FIG. 4 is a side view of one of the horizontal pathway cars according to the present transverse elevator system with its ground wheels engaging the horizontal pathway road surface and its side wheels engaging the horizontal pathways side rails.

As included in the the side track 22 illustrated in FIG. 2, the vertical elevator 20, as well as all the other vertical pathways 17, 18, 19 and 20 include a concrete sides frame 41 with cars 42 slideable therein and driven by cable systems not shown in the drawings because cable systems are conventional in present day technology, but as mentioned above self propelled cars can be employed in the vertical shafts shown at 17, 18, 19 and 20 in FIG. 1, but they would require pathway configurations similar to those shown in FIG. 4 with provisions for holding the cars at their stopped positions.

As discussed above, the reentry controls in FIG. 14 slows and spaces the cars in the main track 12, such as shown at 34 and 36 in FIG. 2 to permit the car 33 to enter the trackway 12 in a safe manner.

Figure 3:
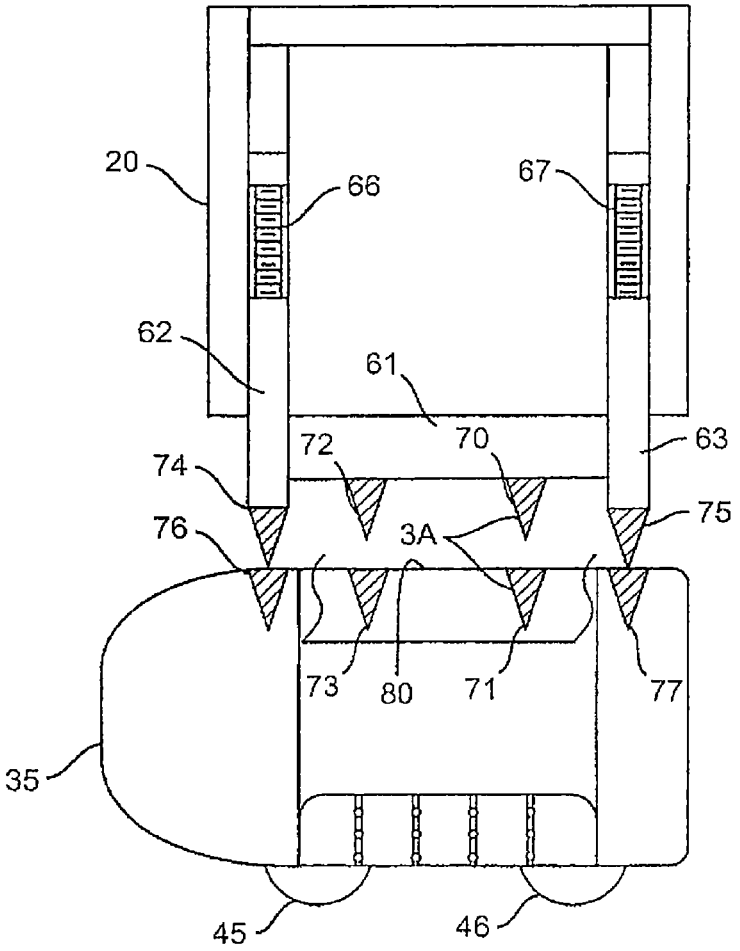
FIG. 3 is a top view of a horizontal car parked at a vertical stop in the present transverse elevator system showing the vertical path side partitions moving toward the car along with a floor partition with their conical locking screws extended.
Figure 5:
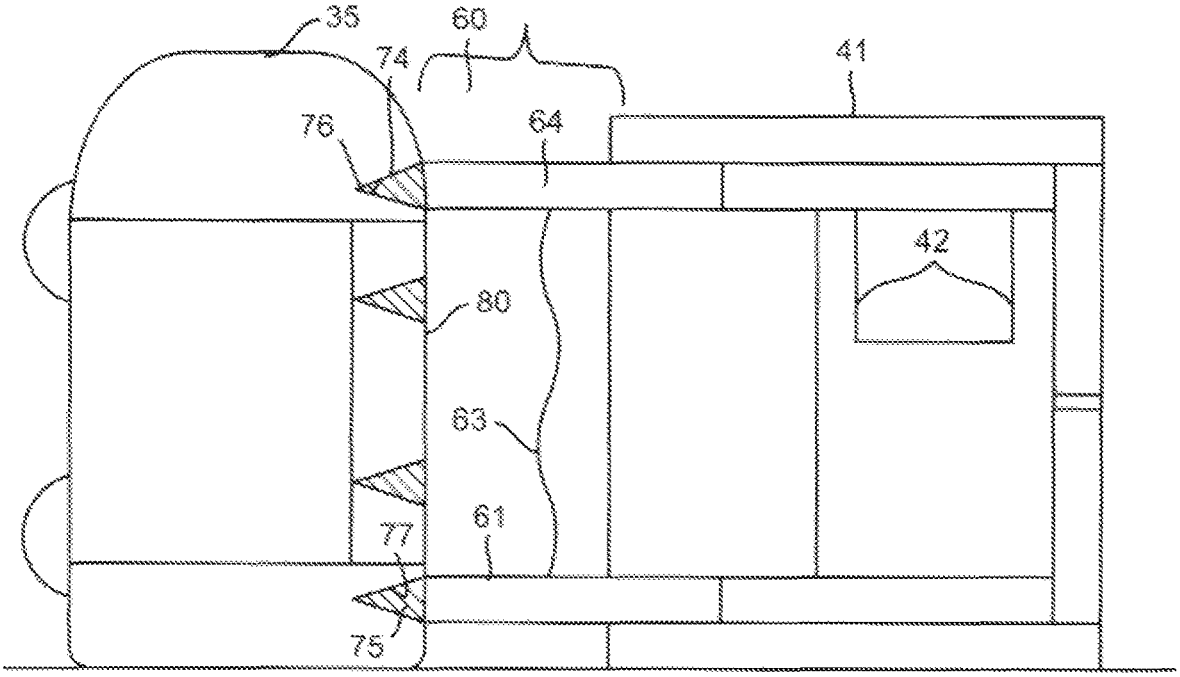
FIG. 5 is a top view similar to FIG. 3 of the present transverse elevator system showing the side partitions and the floor partition locked to a car at a stop.
Figure 6:
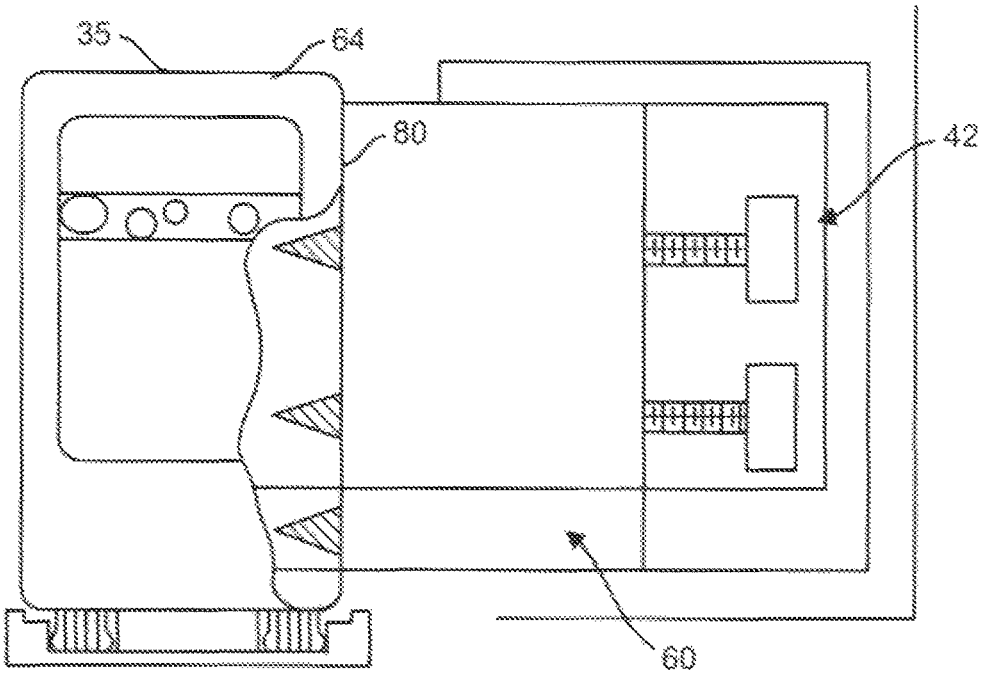
FIG. 6 is a side view similar to the top view of FIG. 5 of the present transverse elevator system showing the side and floor partitions locked to the car at a stop.

Viewing the sub-system shown in FIGS. 3, 5, and 6, a plurality of passenger chutes 60 are provided between the vertical path stops and the cars parked at those stops to enable passengers to pass easily from the horizontal cars into the vertical cars and from the vertical cars back into the horizontal cars in a safe and comfortable manner.

Referring to FIGS. 3 and 4 a horizontal car 35 is shown parked in front of a vertical pathway 20. Viewing the transverse elevator system subassembly shown in FIGS. 3, 5 and 6, the vertical pathway stop areas throughout the system are provided with chutes 60 that are mounted in and extend from the vertical shafts 41 and lock onto the parked horizontal cars to provide a safe and comfortable passenger walk from the horizontal cars to the vertical cars and from the vertical cars back to the horizontal cars.

As seen in FIGS. 3, 3A 5 and 6, the chute 60 is seen to include a bottom or floor panel or partition 61, side panels 62 and 63 and top or roof panel 64. All of these panels are driven from a retracted position completely inside the vertical concrete pathway 41 to the partly extended position shown in FIG. 3 to the fully extended position shown in FIGS. 5 and 6 locked against horizontal car 35—by screw driven electric motor and screw drives 66 and 67 carried by the concrete frame 41. While the drives 66 and 67 are shown driving partitions 62 and 63 in FIG. 3, it should be understood that similar drives are provided on the partitions 61 and 64 as well. The partition drives 66 and 67 are controlled by the route calculator controls in FIG. 13 to extend in sequence with the stopping of each car at its stop in front of a vertical pathway throughout the system.

Each of the partitions 61, 62, 63 and 64 have truss type aluminum frame covered by rigid inside upholstered and outside surface a durable and hard cover layers with slide trackways on their top and bottom edges mounted for linear movement in the vertical pathways 41 with complementary liner tracks.

Each of the partitions is locked to the car 35 with a pair of rotary cone screws such as screws 70 and 72 on partitions 61 in FIG. 3, screws 74 on partition 64, screws 75 on partition 61 both shown in FIG. 5. All of these conical screws rotate and screw into complementary conical threaded holes 71 and 73 in all the cars including car 35 shown in FIGS. 3 5 and 6. It should be noted that FIG. 3 is a top view while FIG. 5 is a left side view so the partition number appear staggered in these views.

Figure 3A:
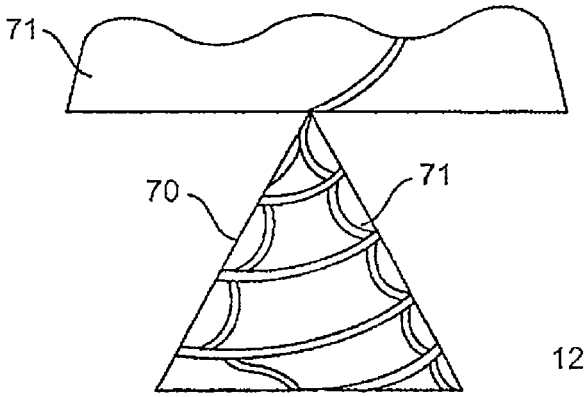
FIG. 3A is an enlarged view of one of the conical screws shown in FIG. 3, showing its polyurethane coating.

Each of the conical screws 70, 72, 74 and 75 as well as the holes 71, 73 76 and 77 are coated with a polyurethane coating 0.500 inches in thickness as shown in the enlarged view in FIG. 3A to dampen vibration, reduce noise and improve locking function.

Figure 13:
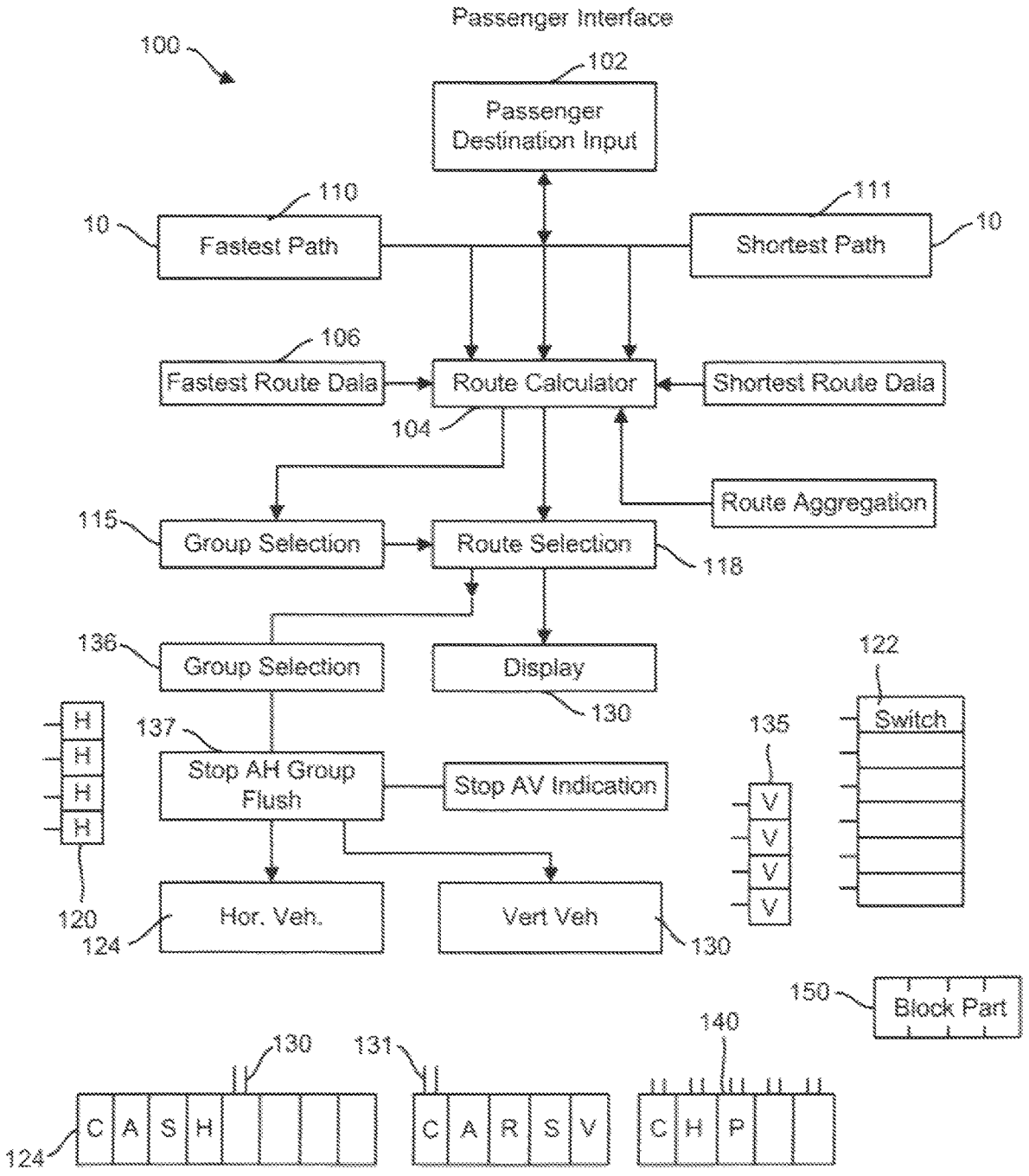
FIG. 13 is a block diagram of the present transverse elevator system controls for the master controls monitoring and controlling car positions and formulating the individual and group pathway routes for each horizontal and each vertical pathway car.

In the fully extended and locked posions of the partitions in FIGS. 5 and 6, the partitions form the chute 60, enabling some or all passengers in the car 35 to walk from the car 35 into the vertical car 42, or some or all passengers from the vertical car 42 into the horizontal car 35 according to the route path calculate by the controls in FIG. 13. After the correct passengers have transitioned, the chute 60 partitions withdraw into the vertical path 41, and car 35 exits the stop and reenters the main track through the entry transition shown in FIG. 2, and the vertical car 42 proceeds up or down the path 41 according to the route programmed by the FIG. 3 controls.

A cross section of the horizontal pathways is illustrated in FIG. 4. shown engaging and guiding one of the horizontal cars 35, with the understanding that all of the horizontal cars are similarly configured, although other types of guiderails are within the scope of the present system. As seen in FIGS. 3 and 4, car 35 as well as the other horizontal pathway cars have four rubber tires 81 and 82 riding in the vertically open tracks 81 and 82, and four rubber tires and wheels 85 and 86 rotatable about vertical axes and engaging inwardly opening side tracks 91 and 92 seen in FIG. 4, these side tracks limit lateral movement and sway of the horizontal cars.

Referring to a second sub-system and embodiment of the present transverse elevator system in FIGS. 7,8, 9 10, 11, and 12 in which passengers are carried in enclosed capsules or capsules go that are moved about the system by the horizontal cars and the vertical cars by shifting the capsules from the horizontal cars to the vertical cars by self propelling mechanisms carried on the capsules. The basic purpose of the capsule system is to eliminate the obvious but impractical otherwise requirement of moving passengers around the system in cars that require uncoupling from the drive mechanism on the horizontal pathway and the complex connection to the vertical drive mechanisms, such as standard cables, which would require excessively complex parts, not to mention long cycle, such as required in the Thyssen-Krupp system discussed above, times making such systems impractical and too expensive in the modern speed dictated infrastructures of today and tomorrow.

The capsule system shown in FIGS. 7 to 12, is illustrated in a preferred environment in these FIGS. in which the capsules utilize the chutes 60 in the FIG. 3 to FIG. 6, system to provide the stable traction interior surfaces for the capsule drive tracks as they motor from the horizontal cars to the vertical cars in the vertical pathways, and also back from the vertical cars to the horizontal cars. However, the chutes 60 have four partitions, all of which may not be required to provide the necessary traction for the capsules and such may only require two partitions such as the floor partition 61 and the top partition 64. And further the partitions could be eliminated or modified so the capsule drives can effect transfer without the partitions if the drives (endless tracks) can shift by themselves, engage and hold onto the vertical car interiors and pull the capsules into the vertical cars and do the same in the opposite direction pulling the capsules into the horizontal cars.

Figure 7:
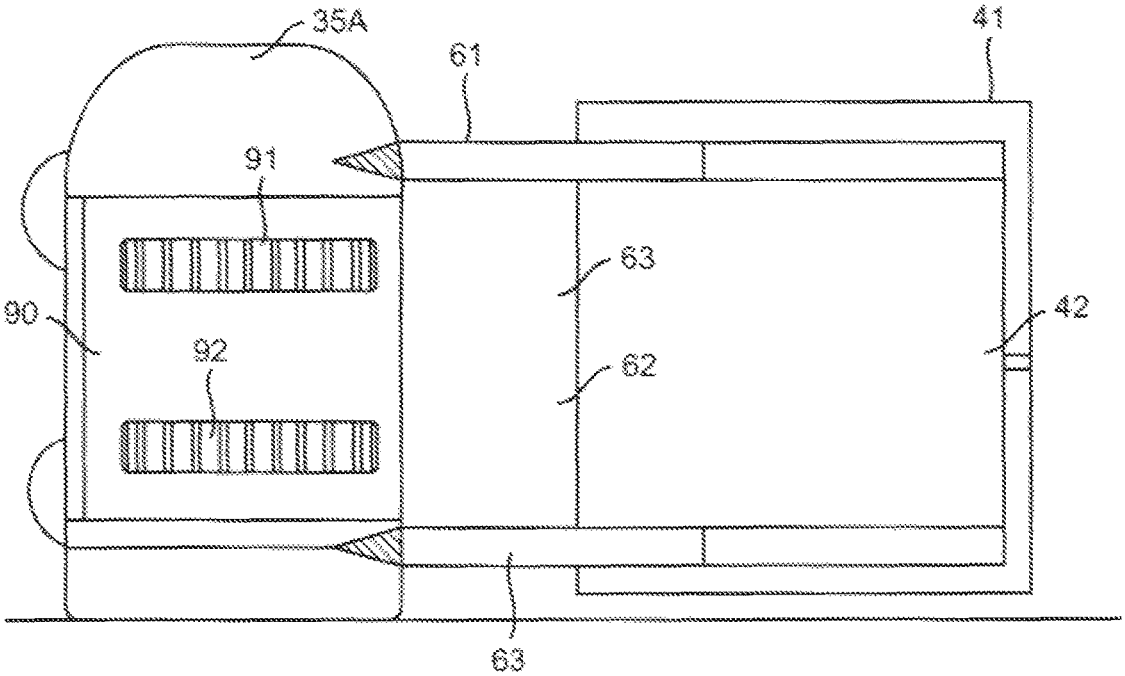
FIG. 7 is a top view of another embodiment of the present transverse elevator system utilizing a capsule to transport the passengers with the partitions similar to the FIGS. 2 to 6 partitions as guideways for the capsules with the partitions locked on a car with its CAPULSE still mounted in the car.
Figure 9:
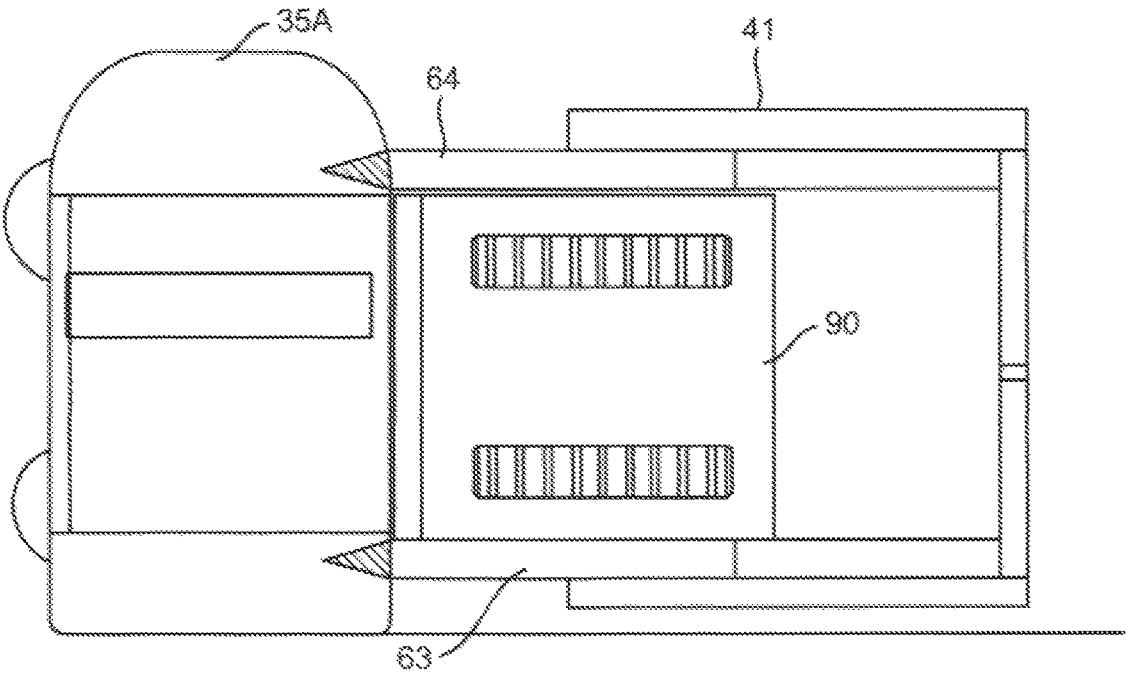
FIG. 9 is a top view and FIG. 10 is a side view of the views shown in FIGS. 7 and 8 respectively of the present transverse elevator system with the car just past half way into the vertical elevator driven by the capsule roof mounted dual rubber endless traction drives.
Figure 10:
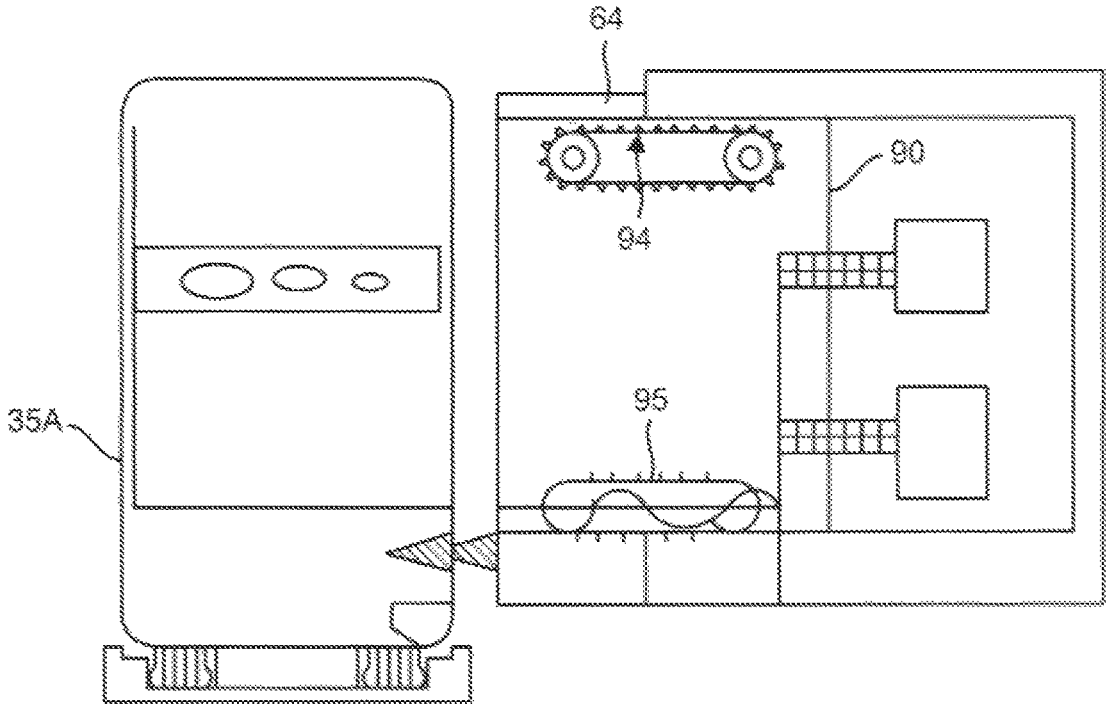
Figure 11:
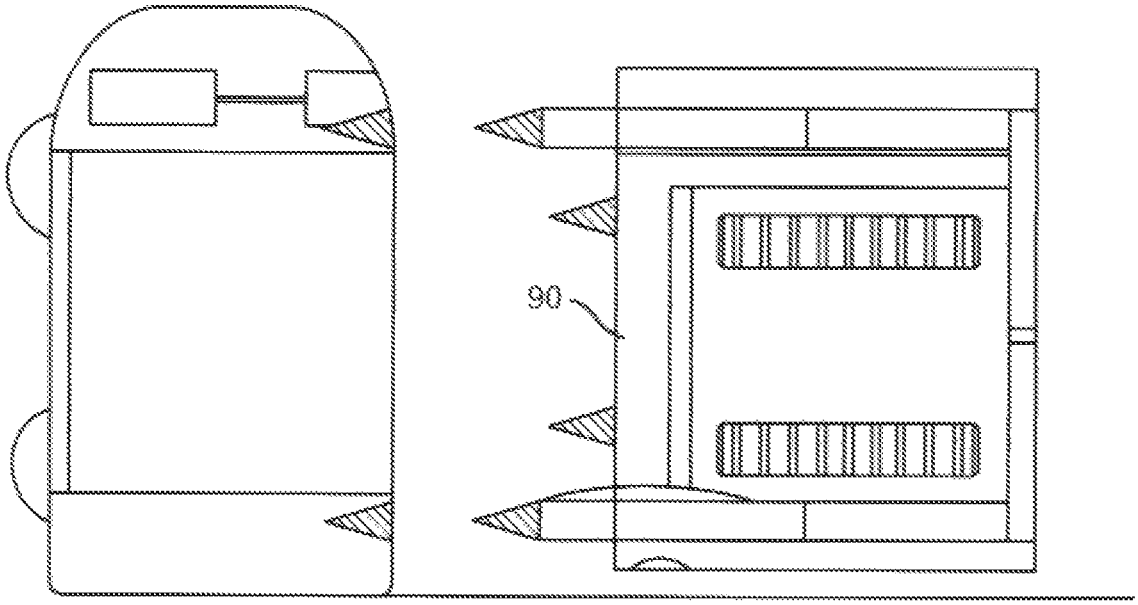
FIGS. 11 and 12 are top and side views similar to FIG. 9 and to of the present transverse elevator system showing the capsule fully transferred into the vertical elevator car and the partitions partly withdrawn from the parked horizontal pathway car at the stop.
Figure 12:
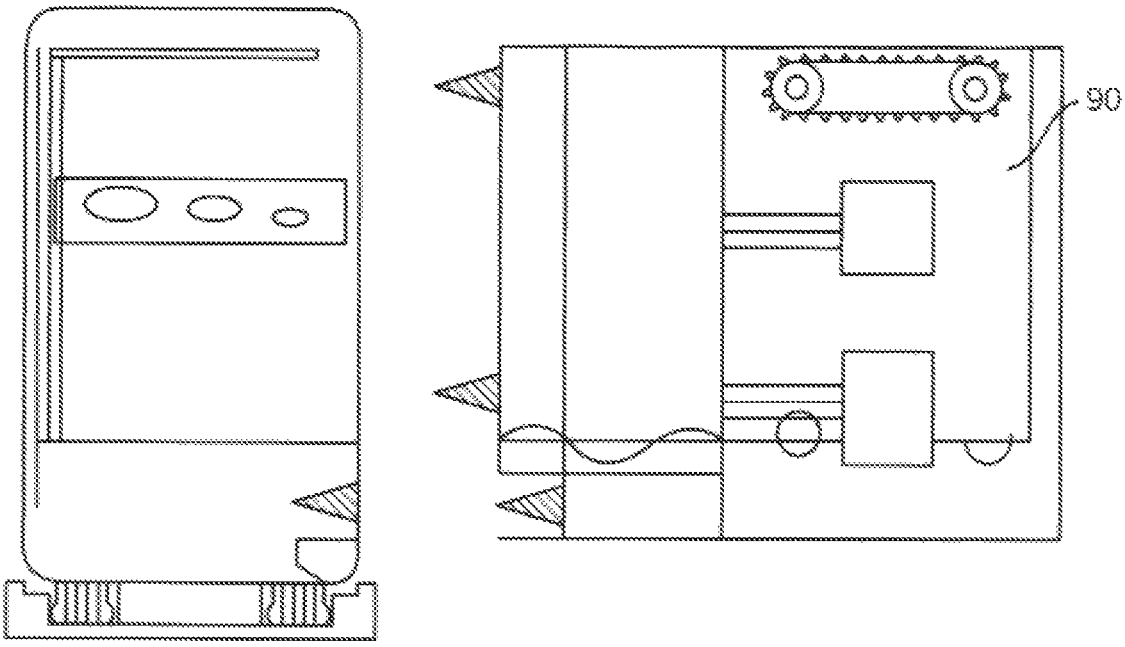

Viewing FIG. 7 to FIG. 12, and particularly FIG. 7, the capsule 9 is shown mounted in one of the horizontal cars 35A, and is seen to include 6 side walls forming an enclosed cube, but it should be understood the capsule 90 also includes sliding doors on two sides so passenger can enter from one side of the cars at entry stops and can exit from one side when the capsules are in one of the vertical such as in the position illustrated in FIGS. 11 and 12. Further the side walls of the capsules may be provided with windows as desired as well as information displays telling the passengers where they are and where they are going similar to the controls display in FIGS. 13 and 14. Furthermore, there may be instances in this capsule system when there is an excess of capsules in the system where passenger routes dictate the transfer of a capsule from a horizontal car to a vertical car when both already house capsules and in such cases the controls of FIG. 13 permit the transfer of passengers by extending and locking the chute 60, opening the outwards facing capsule doors in the horizontal cars and opening the outward doors in the vertical car capsule permitting passenger in the horizontal car to exit through the chute 60 into the open capsule in the vertical car capsule, and then proceeding with a modified passenger route for the newly transferred passengers as well confirming the routes of the already loaded passengers in the vertical car.

Figure 8:
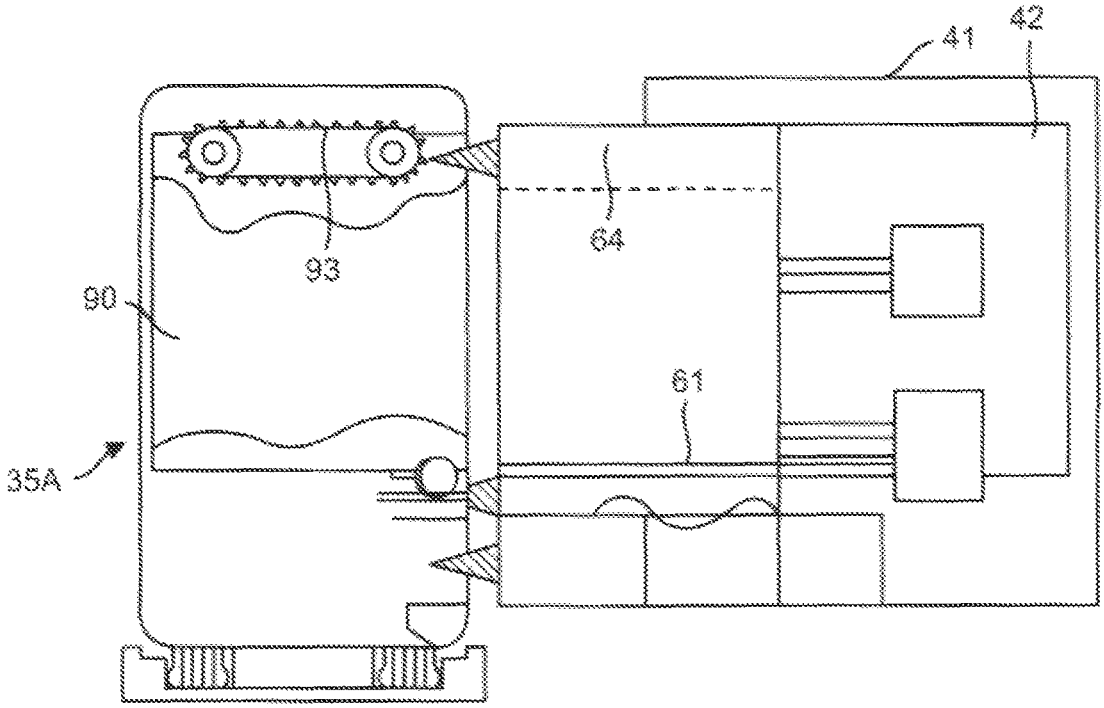
FIG. 8 is a side view of the capsule, car partitions and vertical pathway illustrated in FIG. 7 of the present transverse elevator system showing the partitions just short of locking and the capsule still mounted in the car.

Viewing FIGS. 7 to 12 it should be understood initially that FIGS. 7, 9 and u are top views and that FIGS. 8, 10 and 12 are left side views to avoid confusion. The capsules go are driven by a pair of rubberized endless tracks 91 and 92 that are controlled by the FIG. 13 controls and they drive the capsules 90 to and from the cars 35 to the vertical cars 42 by engaging first the upper surface 93 of the horizontal cars as seen in FIG. 8, driving them outwardly from the cars 35, and engaging the under surface of top partition 64 as shown in FIG. 10 pulling the capsule 90 out of the car 35, and then in one continuous motion, driving the capsule into the vertical car 42, as seen in FIGS. 11 and 12. It should be understood that additional drive features could be provided in addition to the tracks 91 and 92 to aid the capsule shifting. For example the capsules could be equipped with a set of lower tracks 95 as seen in FIG. 10 to provide a more balanced and stronger traction force for the cars at an increase in cost.

Figure 15:
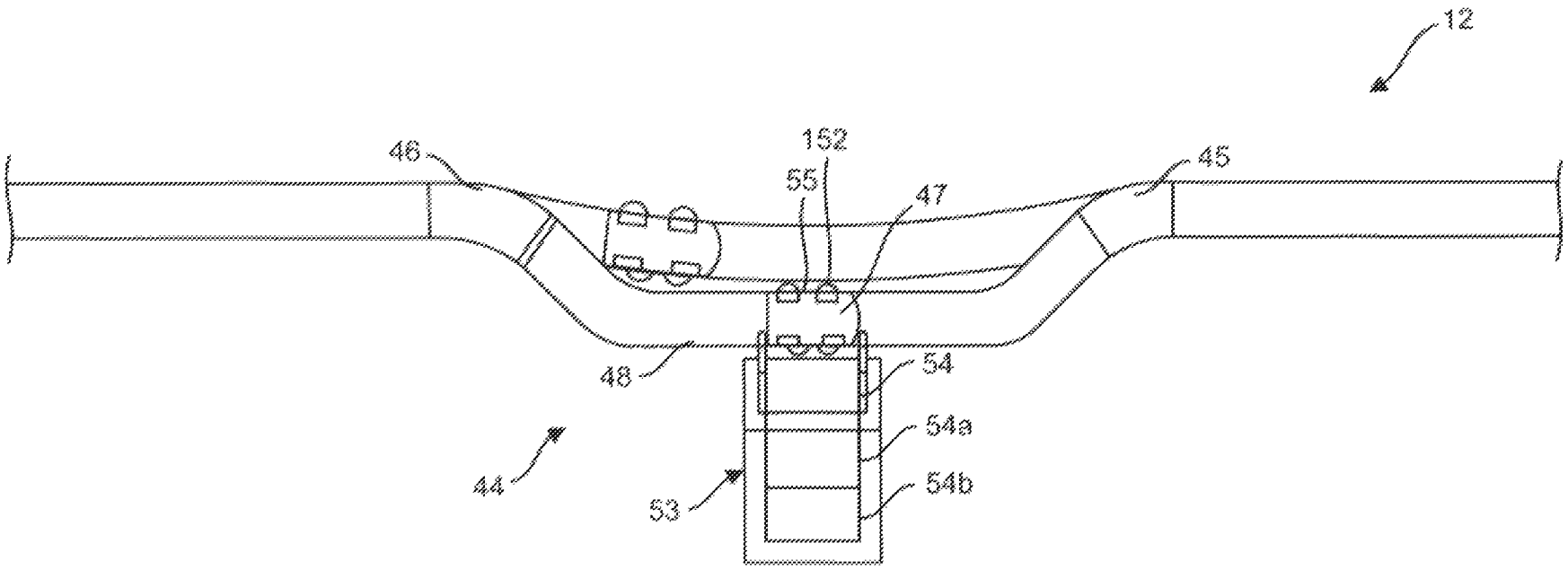
FIG. 15 is a top schematic of one of the CAPULSE add-on-subtract capsule trackways according to the present transverse elevator system.

As noted above the present system 10 has a technique for maintaining a certain percentage of capsules in the system at about 80 percent of the total cars including both horizontal and vertical cars to minimize the blocking condition described herein. Toward that end as seen in FIG. 15, each of the horizontal pathways 12, 13 and 14 is provided not shown in FIG. 1, a side track 44 as seen in FIG. 15 including exit switch 45, a straight stop section 48, and reentry switch 46. Cars in the side track 44 can either drop off or add capsules to the system at stop 55 loading capsules 54, 54A, and 54B form the storage shed 53, into an empty car, or removing a capsule from a loaded car 47 into the storage shed 53. In this way sidetrack 44 increase or decreases the loaded capsules in the horizontal pathways.

As seen in FIG. 1, capsules can also be added or subtracted in the vertical pathways by a storage shed 25 at the top of the vertical pathway 19, (also provided but not shown in the vertical pathways 17, 18 and 20) that houses makeup capsules 26, 26A, and 26B. The car 42 in vertical path 19 as well as the other vertical paths can go to the top of the vertical pathway and either load or unload a capsule from the storage shed 25, in a similar fashion to the horizontal side trackway 44 shown in FIG. 15.

Figure 14:
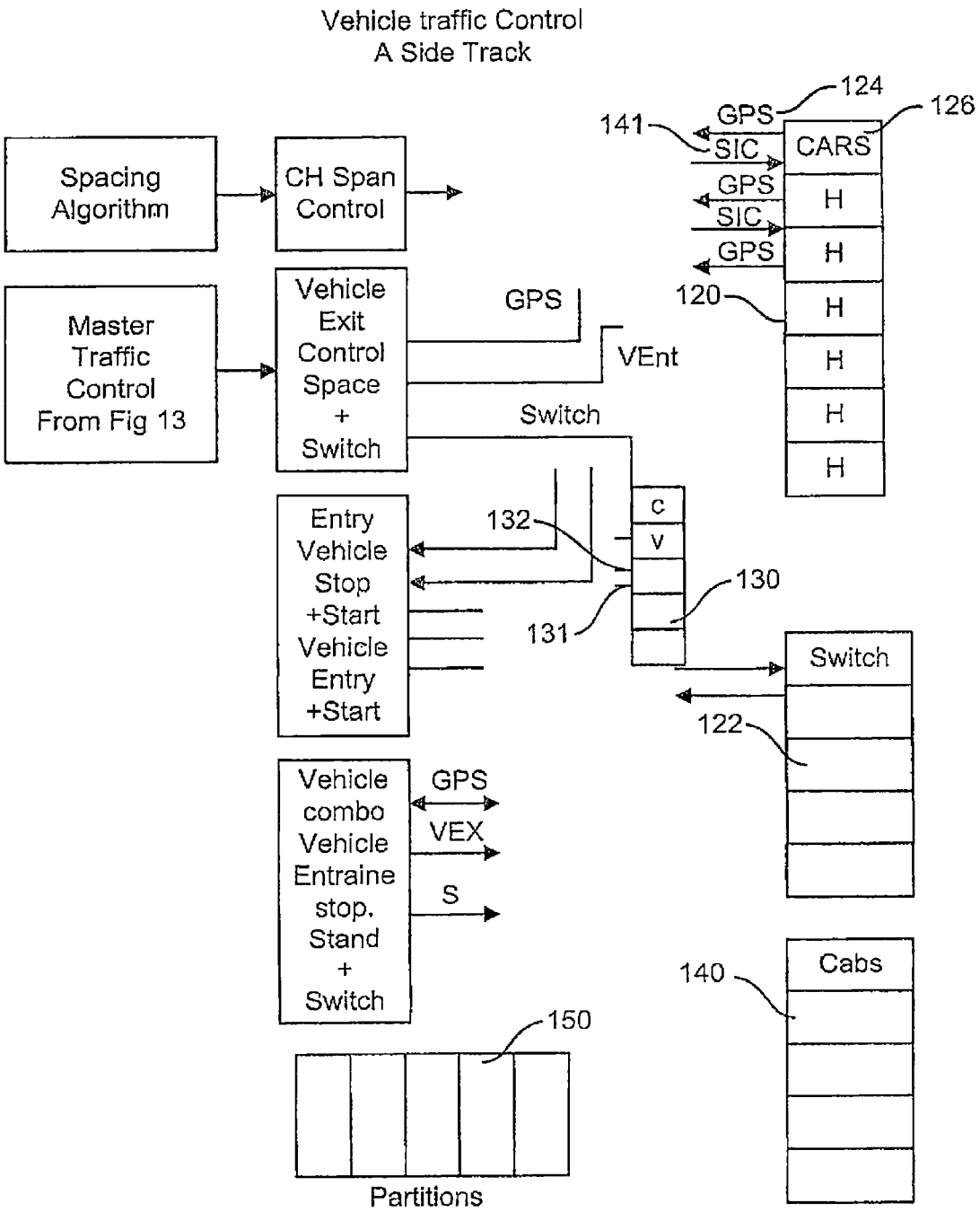
FIG. 14 is a block diagram for the controls of the present transverse elevator system for controlling the car side track entries and exits as well as controlling movement of moving cars on the reentry horizontal pathways to ease the sidetrack cars melding back onto the adjacent horizontal pathway.

The basic controls for the system to are illustrated in FIG. 13, and FIG. 14, with FIG. 13 showing the routing control for the FIG. 5 to 6 sub embodiment as well as the FIG. 6 to FIG. 12 sub embodiment, and FIG. 13 showing the controls for the sidetrack functions illustrated in FIG. 2.

Viewing FIG. 13, the functions shown revolve around the route calculator microprocessor 104 which determines the physical movement of the horizontal cars 124 and the vertical cars 130, by controlling the cars movement and direction with car motor controls and car braking, the stop positions of the cars, the sidetrack direction of the car through switches 122, the movement of the capsules 90 by controlling motors driving the tracks 91 and 92, controlling singular and blocking movement of the partitions and chutes 60. Passengers enter their destination data at 102 located both at the horizontal entrance—exits 152 in FIG. 2 and at the vertical entrance-exits 150 also in FIG. 2, with the understanding that similar entrance—exits are located in the same place throughout the system 10. Routing information is shown in displays 130 in FIG. 13 in each of the horizontal and vertical cars visible to all passengers in those cars.

Passengers select a route-either the fastest or shortest determined by route modifiers 110 and 111. A route sector 118 sends its route to a Group selector 136 and combines routes selected by multiple passengers and combines them using a complementary route segment algorithm (passengers with different routes but common route portions and directs passengers through the displays 130 to the correct car for their journey so that the passengers in each group travel together in the same car for part of their travel routes. Or more clearly for their common journey segments.

The route calculator also send signals sequentially to the switches 122, the capsule movement control 140 as well as the chute extender and the block controls 150. The block controls 150 move the chutes 60 in both the normal function of the chutes without the capsules 90 and with the capsules 90 in the blocking function of the system when a horizontal car holding a capsule meets at a stop with a vertical car 42 also holding a capsule creating what is defined herein as a blocking condition. In the latter case, the Route selector 118 senses that condition, transfers the desired passengers though chute 60 to the vertical car and then recalculates the route for those transferred passengers and displays the routes on the display in the transfered passenger car, and also does the reverse when a vertical car carrying a capsule 90 stops at a horizontal car with a mounted capsule.

Note in FIG. 13 that the cars, both vertical and horizontal have feedback gps 130 and 132 as well as motor control and breaking inputs 124 and 131.

Viewing FIG. 14, and as noted above these controls take the route information from the route calculator 118 in the master controls selector 118, and dissects the route information into its side track segments, and overrides the normal side track data routes of the FIG. 13 routing, controls the horizontal cars 34 and the switches 48, the stop of the car at stop 56, the chute and capsule controls at the stop, the speed of the ear 33 from the stop, the spreading and slowing of the cars 34 on the main horizontal track 12 approaching the sidetrack, the position of switch 52 and the reentry of the car safely back on the main horizontal track 12.

The invention claimed is:

1. A transverse elevator system having generally horizontal and generally vertical components, comprising: a horizontal pathway for guiding at least one first object vehicle, a generally vertical pathway for guiding at least one second object vehicle in a vertical pathway without any horizontal movement, said horizontal pathway including at least one stop at said vertical pathway, said one stop including an extension forming a pathway for objects passing between the first object vehicle and the second object vehicle and extending from the vertical pathway for engaging at least one of the first object vehicle and stabilizing said first object vehicle at said one stop relative to said extension to facilitate the transfer of objects from the first object vehicle to one of said second object vehicle in said vertical pathway.

2. A transverse elevator system having generally horizontal and generally vertical components, as defined in claim 1, including an object carrying capsule in at least one of the first object vehicle, and means for transferring the capsule from said one first object vehicle at said one stop to one of said second object vehicle when the one first object vehicle is adjacent said vertical pathway at said one stop, whereby operating mechanisms for the horizontal and vertical pathways remain unaffected as objects are transferred from the horizontal direction to the vertical direction.

3. A transverse elevator system having generally horizontal and generally vertical components as defined in claim 1, said object being a human passenger, wherein said extension includes at least one horizontally moveable partition extendable from the vertical pathway into engagement with one first object vehicle when the first object vehicle is at the one stop.

4. A transverse elevator system having generally horizontal and generally vertical components as defined in claim 1, including a plurality of extendable partitions extendable from the vertical pathway into engagement with the one first object vehicle, and rotary locks on a distal portion of the partitions for securing the one first object vehicle to the vertical pathway to facilitate movement of objects from the first object vehicle in the horizontal pathway to the second object vehicle in the vertical pathway.

5. A transverse elevator system having generally horizontal and generally vertical components as defined in claim 1, said object being an human passenger, including a plurality of vertical pathways along the horizontal pathway, each with at least one second object vehicle in each vertical pathway, and including one stop along the horizontal pathway at each vertical pathway so objects in the horizontal pathway can transfer to each of the vertical pathways at each of the one stops.

6. A transverse elevator system having generally horizontal and generally vertical components as defined in claim 5, wherein each of said vertical pathways includes a plurality of extensions engageable with the first vehicles in the horizontal pathway.

7. A transverse elevator system having generally horizontal and generally vertical components as defined in claim 1, wherein said extension includes a chute having a floor panel with upstanding side panels and a top panel all extending between the vertical pathway and the first passenger vehicle.

8. A transverse elevator system having generally horizontal and generally vertical components, comprising: a horizontal pathway for guiding a first object vehicle, a generally vertical pathway for guiding a second object vehicle, said horizontal pathway including a stop at said vertical pathway, an object carrying capsule in said first object vehicle, and means for transferring the capsule from said first object vehicle at said stop to said second object vehicle when the first object vehicle is adjacent said vertical pathway at said stop, whereby operating mechanisms for the horizontal and vertical pathways remain unaffected as objects are transferred from the horizontal to the vertical direction.

9. A transverse elevator system having generally horizontal and generally vertical components as defined in claim 8, said object being an human, including a plurality of vertical pathways along the horizontal pathway, each with at least one second object vehicle in each vertical pathway, and including one stop along the horizontal pathway at each vertical pathway so objects in the horizontal pathway can transfer to each of the vertical pathways at each of the one stops.

10. A transverse elevator system having generally horizontal and generally vertical components as defined in claim 8, including a plurality of vertical pathways along the horizontal pathway, each with at least one second object vehicle in each vertical pathway, and including one stop along the horizontal pathway at each vertical pathway so objects in the horizontal pathway can transfer to each of the vertical pathways at each of the one stops.

11. A transverse elevator system having generally horizontal and generally vertical components as defined in claim 8, wherein the capsule is a 360 degree envelope surrounding the objects therein.

12. A transverse elevator system having generally horizontal and generally vertical components as defined in claim 8, including a plurality of first object vehicles and a capsule is provided in each of the first object vehicles for transfer to said second object vehicle.

13. A transverse elevator system having generally horizontal and generally vertical components as defined in claim 11, including a traction drive iso assembly for the capsule moveably mounted at least in part on an upper surface of the capsule.

14. A transverse elevator system having generally horizontal and generally vertical components as defined in claim 13, including an extendible partition from the vertical pathway engageable with the first vehicle to hold said first vehicle in a locked position, said traction drive being engageable with the partition to drive the capsule in the first vehicle into the second vehicle.

15. A transverse elevator system generally horizontal and generally vertical components as defined in claim 13, wherein the traction drive includes an endless belt.

16. A transverse elevator system having generally horizontal and generally vertical components as defined in claim 15, wherein said extendable partition includes at least one horizontally moveable partition extendable from the vertical pathway into engagement with the one first object vehicle when the first object vehicle is at the one stop.

17. A transverse elevator system having generally horizontal and generally vertical components as defined in claim 14, including a plurality of extendable partitions extendable from the vertical pathway into engagement with the one first object vehicle, and rotary locks on a distal portion of the partitions for securing the one first object vehicle to the vertical pathway to facilitate movement of objects from the first object vehicle in the horizontal pathway to the second object vehicle in the vertical pathway.

18. A transverse elevator system having generally horizontal and generally vertical components as defined in claim 14, wherein the objects are human passengers, and including a plurality of vertical pathways along the horizontal pathway, each with at least one second object vehicle in each vertical pathway, and including one stop along the horizontal pathway at each vertical pathway so objects in the horizontal pathway can transfer to each of the vertical pathways at each of the one stops, wherein each of said vertical pathways includes a plurality of extendable partitions engageable with the first vehicles in the horizontal pathway.

19. A transverse elevator system having generally horizontal and generally vertical components, comprising: a horizontal pathway for guiding a plurality of first object vehicles, a generally vertical pathway for guiding at least one second object vehicle, said horizontal pathway including at least one stop at said one vertical pathway, wherein the stop includes a first side track from the horizontal pathway to the one vertical pathway permitting the first vehicles to pass the vertical pathway on the horizontal pathway, when a first vehicle is on the side track at said one stop to minimize first vehicle slowing by first vehicles located at the stop at the vertical pathway, and a second side track from said one vertical pathway back to the horizontal pathway permitting the first vehicle on the first side track to return to the horizontal pathway.

20. A transverse elevator system having generally horizontal and generally vertical components, as defined in claim 19, wherein the first and second side tracks include a straight stop pathway defining said one stop and connected between the first and second side tracks.

21. A transverse elevator system having generally horizontal and generally vertical components, as defined in claim 19, including a control for modifying the locations of one or more first object vehicles along the horizontal pathway near the side tracks to permit the first object vehicle in the side tracks to reenter the horizontal pathway without interference from any first object vehicle already in the horizontal pathway.

* * * * *